United States Patent [19]

Arakawa et al.

[11] 4,393,360

[45] Jul. 12, 1983

[54] ELECTRICAL SWITCH STRUCTURE

[75] Inventors: Kaneyasu Arakawa; Shigeo Mizuno, both of Nagoya, Japan

[73] Assignee: Kabushiki-Kaisha Tokai-Rika-Denki-Seisakusho, Aichi, Japan

[21] Appl. No.: 268,092

[22] Filed: May 27, 1981

[30] Foreign Application Priority Data

May 27, 1980 [JP] Japan ..... 55-72003[U]

[51] Int. Cl.[3] ..... H01H 9/20

[52] U.S. Cl. ..... 335/164; 335/166; 335/186

[58] Field of Search ..... 335/164, 165, 166, 186, 335/188; 74/2, 529, 540

[56] References Cited

U.S. PATENT DOCUMENTS 3,842,375 10/1974 Collette ..... 335/164

FOREIGN PATENT DOCUMENTS 543027 8/1922 France ..... 335/164

*Primary Examiner*—Harold Broome

*Attorney, Agent, or Firm*—Carroll F. Palmer

[57] ABSTRACT

An electrical switch structure comprising a lever rotatably mounted between neutral position and actuated position, a switching element ON-OFF operated by said lever, a latching means to latch said lever in the actuated position and an unlatching means to rotate back said lever to the neutral position. In one type of the switch said latching means is accomplished by the energization of a solenoid, in other type of the switch said unlatch means being accomplished by said energization of the solenoid.

5 Claims, 8 Drawing Figures

ELECTRICAL SWITCH STRUCTURE

BACKGROUND OF THE INVENTION

This invention relates to an electrical switch structure wherein a switching element is ON-OFF operated manually by a lever and especially to an electrical switch structure in which said lever is latched in the actuated position and unlatched back to the initial neutral position.

In the prior art system, such kind of the switch structure as stated above has been used in a vehicle as a turn signal indicator switch, window regulator switch, sun roof switch and the like. Among those switches the turn signal indicator switch is equipped around the steering shaft and so designed that the lever moves back willy-nilly from the latched actuated position to the unlatched neutral position when a driver has rotated the steering wheel back after completing a turn.

Pursuant to said turn signal indicator switch, the mechanism to release the lever from the actuated position comprises an interlocking device physically coupled to the steering shaft so that the structure itself becomes complicated, while disadvantageously the part components are likely to wear to cause a failure. In addition, the configuration is such that the lever has to be disposed around the steering shaft so that the setting location is regulated.

On the other hand, in the window regulator switch the lever is required to be self-held in the latched actuated position until the window is fully open or closed. For this purpose a solenoid operated plunger has been conventionally employed as a self-holding means where said plunger is movably mounted in a dual direction so as to be responsive to the open and close action of the window glass so that the whole structure itself disadvantageously becomes large.

OBJECTS

A first object of the invention is to provide a simple unlatching mechanism to automatically rotate a lever back from the latched actuated position to the unlatched neutral position in an electrical switch structure.

A second object of the invention is to provide a compact solenoidal structure in an electrical switch structure.

A third object of the invention is to provide an electrical switch structure in which the setting location is not regulated.

BRIEF DESCRIPTION OF THE DRAWINGS

The above and other objects or features of the invention will be apparent from the following description taken in conjunction with the accompanying drawings in which like numerals refer to like parts wherein.

DESCRIPTION OF PREFERRED EMBODIMENTS

Figure 1:
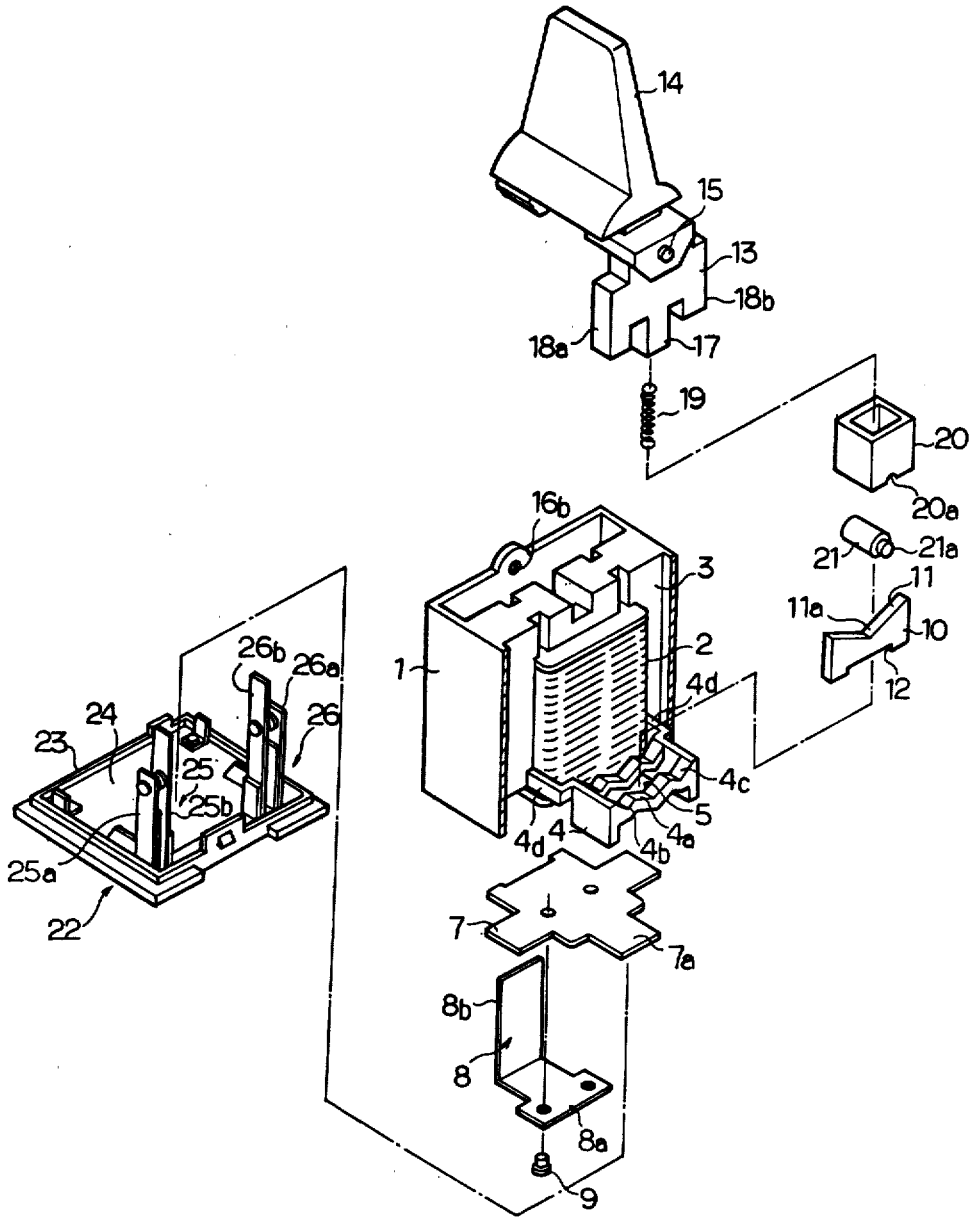
FIG. 1 is an exploded perspective view of an electrical switch structure according to a first embodiment of the invention.
Figure 2:
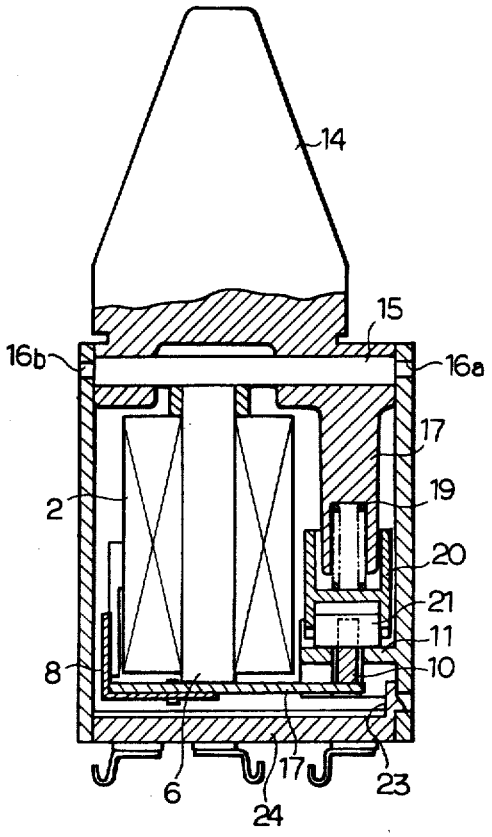
FIG. 2 is a longitudinal cross-sectional view of an electrical switch structure according to the first embodiment of the invention.
Figure 3:
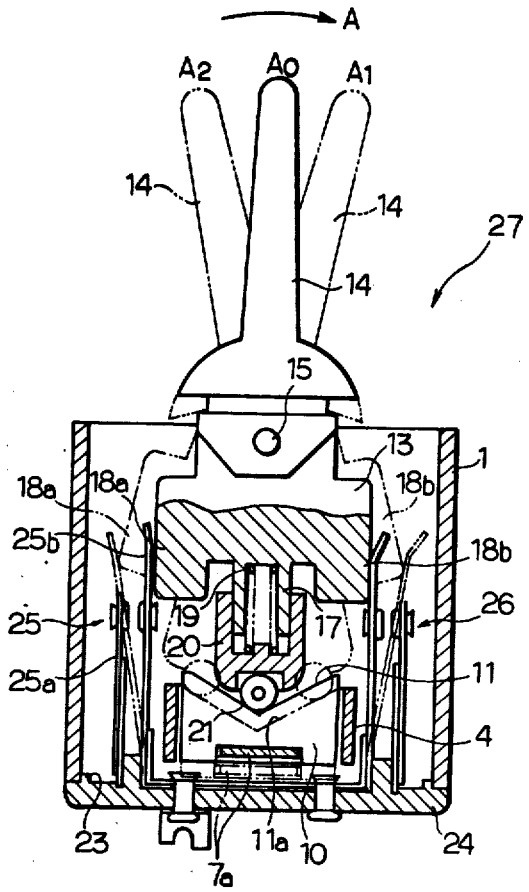
FIG. 3 is a lateral, cross-sectional view of the first embodiment switch.
Figure 4:
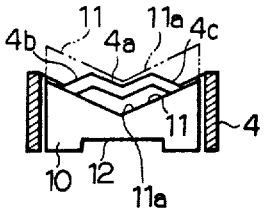
FIG. 4 is a lateral cross-sectional view showing an arrangement of a latching mechanism.

Referring first to FIGS. 1–4, within a plastic case 1 serving as a stationaty member, is a mounting frame 3 integrally formed with a solenoid 2 in place. Numeral 4 shows an inverse U-shaped latching element having an upper undulated area, the middle valley 4a of which acts as a neutral position holding means while valleys 4b and 4c each abutting right and left of said valley 4a act as actuated position holding means. And said upper undulated area is provided with an elongated aperture 5 transversing the vally portions. Said latching element 4 is integrally formed with a couple of arms 4d extending forward from the lower portions of the frame 3 as if to sandwitch the solenoid 2. A L-shaped spring leaf 8 is secured at the lateral end 8a to a movable iron plate 7 in criss-cross shape by means of rivets 9. The upright end 8b of the leaf spring 8 abuts the rear portion of the solenoid 2 so that the iron plate 7 is magnetically detented to a core 6 of the solenoid 2 by the magnetical attractive force against the spring effort when energized. A cancel plate 10, which serves as an unlatching means, has an upper V-shaped guideway 11 and a lower cutout 12, and is vertically movable inserted into the aperture 5 of said latching element 4 which the free end of said iron plate 7 inserted in the cutout 12. Said guideway 11 of the cancel plate 10 normally flushes with the undulating surface of the latching element 4 or positions slightly lower than that as seen in FIG. 4 so that when the iron plate 7 is magnetically detented to the core 6, the cancel plate 10 is raised to such a position that the guideway 11 is higher than the valleys 4a, 4b and 4c as seen in the phantom line in FIG. 4. To a plate-like lever 14 from which an actuator block 13 depends is a pin 15 laterally secured, each end of which is respectively journalled in the holes 16a and 16b provided with the case 1. Said actuator block 13 has a middle tubular receptacle 17 into which a compressive coil spring 19 is enclosed and a couple of push rode 18a, 18b juxtaposed at both sides of said receptacle 17 to form a lateral E-shaped configuration as a whole. At the lower portion of said receptacle 17 is a tubular frame 20 movably telescoped on receptacle 17 and biased downwardly by the effort of said spring 19. Each lower end of the front and rear wall of said frame 20 has semi-circular notch 20a into which an sliding member, for example, a roller 21 is received through its shaft 21a for rotation so that the roller 21 may ride on the undulating surface of said latching element 4. A switch assembly 22 includes an insulating plate 24, on the outer peripheral end of which a flange 23 integrally projects upwardly which is to be telescoped into the lower open end of said case 1 as seen in FIG. 3. On the right and left sides of said insulating plate 24 are switching elements 25 and 26 vertically anchored, each of which comprises a stationary contact blade 25a (26a) and a movable contact blade 25b (26b). With the insulating plate 24 secured to the lower end of the case 1, the actuator block 13 is located between the movable contact blades 25b and 26b as seen in full line in FIG. 3.

In operation when the electrical switch structure 27 thus far described is employed as a turn signal indicator switch of a vehicle, as seen in FIG. 3, the lever 14 is first held restrained in full line neutral position (Ao) with the roller 21 interfit into the valley 4a of the latching element 4. When the lever 14 is rotated about the pin 15 in the arrowed direction A, the roller 21 climbs up the ramp of the undulating surface of said latching element 4 to move from the valley 4a to 4b so that the roller 21 is held restrained in the valley 4b. As a result, the lever 14 is latched in the phantom line actuated position (Ai) as best seen in FIG. 3. At this time the push rod 18a depresses the movable contact blade 25b to move into engagement with the stationary contact blade 25a for closing so that a turn signal light (not shown) equipped in the vehicle is activated. In this situation if a driver rotates the steering wheel back after completing the turn, the solenoid 2 is temporarily energized through an activated switch (not shown) to make the iron plate 7 magnetically detented to core 6 so that the canceling plate 10 moves upwardly to expel the roller 21 from the valley 4b to the valley 11a of the guideway 11 in order to rotate the lever 14 back to the initial neutral position (Ao). Associated with the rotating back operation of the lever 14, the push rod 18b moves back to disengage the movable contact blade 25b from the stationary contact blade 25a to deactivate said turn signal light.

The lever 14 is in this manner unlatched to automatically rotated back from the actuated position (A1) to the neutral position (Ao). The operation is readily set forth similar to that stated above when the lever 14 is rotated from the neutral position (Ao) to another actuated position (A2) located in the opposite side of the position (A1) as seen in the phantom line in FIG. 3.

The electrical switch structure 27 thus far described has following novel features: that is, since the engagement of the roller 21 with the valleys 4b and 4c may be forcefully broken owing to the upward movement of the cancel plate 10 when the solenoid 2 is energized, the valleys 4b and 4c may be cut deeper to strengthen the latching effect.

In addition to that, the fact that the lever 14 is rotated back by the energization of the solenoid 2 eliminates the necessity to mechanically interlock the lever to the steering shaft for unlatching. This makes it possible to provide a simple and compact electrical switch structure. This also allows to locate the switch freely not being confined to where the steering shaft is situated.

Figure 5:
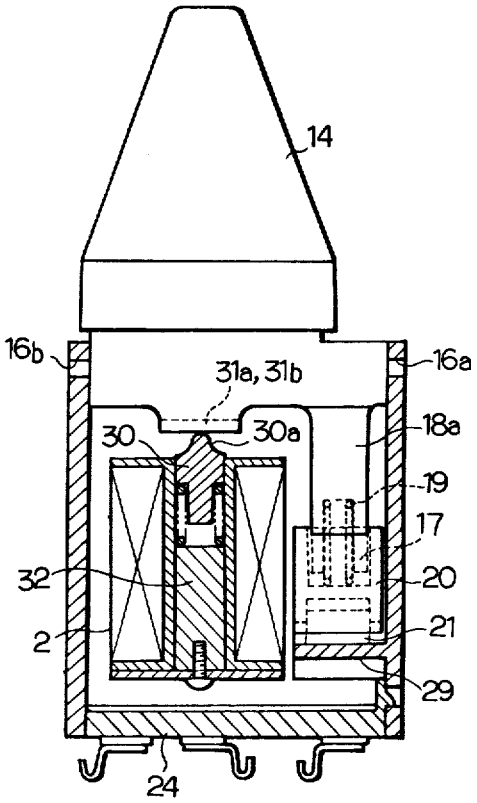
FIGS. 5 and 6 are views respectively similar to FIGS. 2 and 3 according to a second embodiment of the invention.
Figure 6:
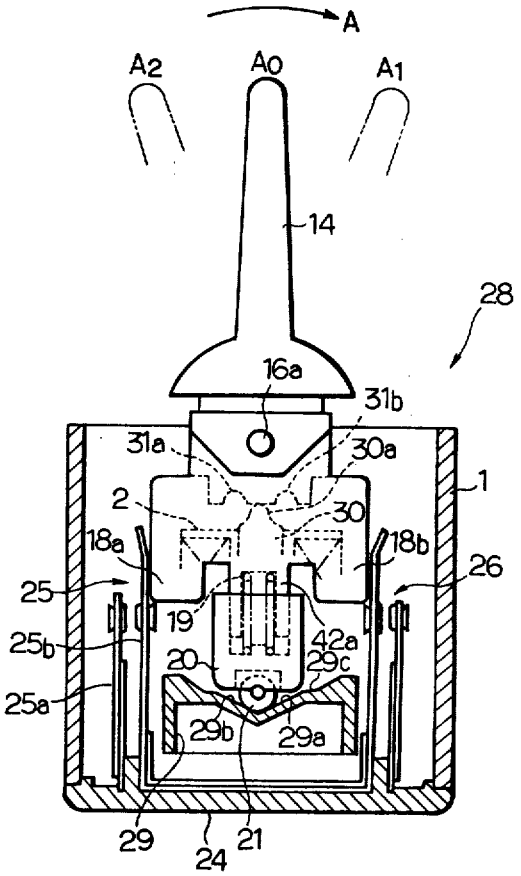

Referring next to FIGS. 5 and 6, a second embodiment of the invention will be described hereinafter. An actuating means 29, instead of the latching element 4, is arranged at the similar location to said element 4 shown in FIG. 1. On the upper surface of said actuating means 29, in addition to a middle valley portion 29a, relatively mild ramp portions 29b and 29c are provided as if to extend outwardly from the both sides of said middle valley portion 29a. So the roller 21 usually has a tendency to slide down along the ramp portion 29b or 29c toward the valley portion 29a regardless whether the lever 14 is in the actuated positions (A1) or (A2). On the lower surface of the lever 14 are recesses 31a and 31b provided in the abutting relation in the rotational direction of the lever 14 so as to act as a latching element into which a spring loaded core 30 is to selectively interfit. Said spring loaded core 30, which serves as an unlatching element, is placed within the solenoid 2 into which a stationary core 32 is coaxially inserted so that the core 30 may be moved toward said stationary core 32 against the spring effort when the solenoid 2 is energized. The other arrangements than those are identical to those shown in FIGS. 1-3.

In operation of the electrical switch structure 28 thus far described according to the second embodiment of the invention, when the lever 14 is rotated from the neutral position (A0) to the actuated position (A1), the roller 21 is moved from the valley portion 29a to the ramp portion 29b while the uppermost portion 30a of the spring loaded core 30 interfits into the recess 31b and the switch element 25 is energized by means of the push rod 18a in the similar manner to the first embodiment of the invention. In this way, the lever 14 is latched in the actuated position (A1) with the spring loaded core 30 engaged with the recess 31b. In this situation, when the solenoid 2 is temporarily energized by a switch (not shown) responsive to the rotating back operation of the steering wheel, the lever 14 is automatically rotated back from the actuated position (A1) to the neutral position (A0) due to the fact that the spring loaded core 30 is magnetically attracted to move toward the stationary core 32 so that the core 31 gets out of the recess 31b, while the roller 21 slides down along the ramp portion 29b to interfit into the valley portion 29a.

Figure 7:
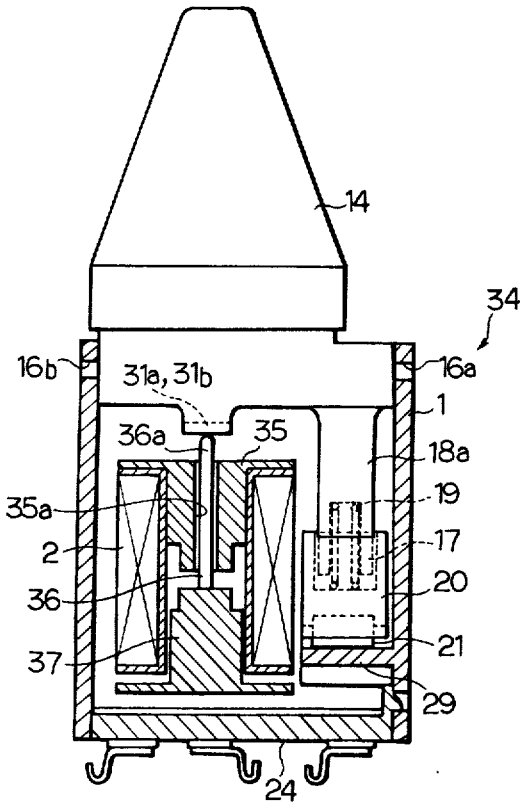
FIG. 7 is a view similar to FIG. 4 in accordance with a third embodiment of the invention.

In reference to FIG. 7, a third embodiment of the invention will be described hereinafter. In this embodiment an electrical switch structure 34 includes a cylindrical stationary core 35 disposed in the upper parts of the solenoid 2 and a movable core 37 adapted to be vertically movably arranged beneath said stationary core 35 so that the movable core 37 may move upwardly by the attractive force of said stationary core 35 when the solenoid 2 is energized. Furthermore a latching rod 36 serving as a latch actuating member extends clear through the hollow portion 35a of the stationary core 35, the lower end of said rod 36 is secured to said movable core 37, while the uppermost portion 36a of said rod 36 being selectively engageable with the recesses 31a and 31b in the similar manner to that shown in FIG. 6. Any other arrangements than those are indentical to those shown in FIG. 6.

With the structure thus far described as an electrical switch structure 34, it should be apparent that an operator can rotate the lever 14 from the neutral position (A0) to the actuated position (A1) and as a consequence, the roller 21 moves from the valley portion 29a to the ramp portion 29b, while the switch element 25 is closed to energize the solenoid 2 so that the movable core 37 is magnetically attracted toward the stationary core 35 to move the uppermost portion 36a into engagement with the recess 31b. As a result, the lever 14 is latched in the actuated position (A1) with the switch element 25 self-held in ON state. During the self-holding period, if the switch structure 34 is used as a vehicular window regulator switch, the window glass moves for closure. After its complete closure the solenoid 2 is deenergized by means of a position sensing switch (not shown). Subsequently the movable core 37 falls by self-weight so that the latching rod 36 gets out of the recess 31b, while the lever 14 automatically rotates back from the actuated position (A1) to the neutral position (A0) owing to the fact that the roller 21 is moved back from the ramp portion 29b to the valley portion 29a. Upon opening said vehicular window glass, it should be also apparent that the operator can rotate the lever 14 from the neutral position (A0) to the actuated position (A2) so as to close the switch element 26. At this time said switch element 26 is self-held in ON state in the similar manner to that stated above by the energization of the solenoid 2.

As is readily understood from the structure thus far set forth, the construction of said solenoid 2 is such that the movable core 37 simply moves in a single direction. Consequently, as contrasted to that of the dual-direction type, is a simple and compact solenoid provided.

Figure 8:
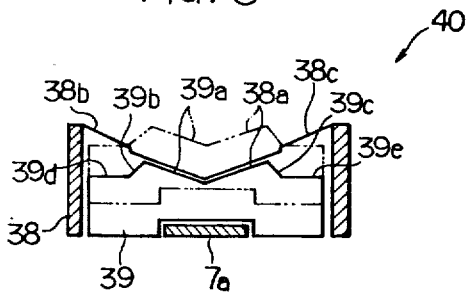

Referring now to FIG. 8, a fourth embodiment of the invention will be described hereinafter as a modification of the first embodiment shown in FIGS. 1-3. In FIG. 8 wherein only different parts are shown from those shown in FIGS. 1-3, in place of the latching element 4 of FIG. 1 is an actuating means 38 arranged which has a similar valley portion 38, ramps 38*b*, 38*c* and an elongated aperture 38*d* to those shown in FIG. 1. A latching plate 39 serving as a latch actuating member is vertically movably inserted into said elongaged aperture 5 so as to move upwardly and downwardly in response to the energization and deenergization of the solenoid 2 in the similar manner to that shown in FIG. 1. On the upper surface of said latching plate 39 are provided a middle valley portion 39*a* and flat portion areas 39*d*, 39*e* extending outwardly from the both sides of said valley portion 39*a* though ramp portions 39*b* and 39*c* which respectively act as a upright member. When the lever 14 is in the neutral position (A0), the roller 21 interfits into the valley portion 38*a*. Subsequently when the lever 14 is rotated from said neutral position (A0) to the actuated position (A1), the roller 21 moves out of the valley portion 38*a* to the ramp 38*b*. In combination with the rotational operation of the lever 14 said above, the switch element 25 is closed the energize the solenoid 2 so that the latching plate 39 moves upwardly to have the ramp portion 39*b* engage with the roller 21. In consequence the roller 21 is prevented from moving back to the valley portion 38*a* to latch the lever 14 in the actuated position (A1). Under the latched condition said above, when the solenoid 2 is deenergized the latching plate 39 moves downwardly to have the ramp portion 39*b* disengage with the roller 21 so that the roller 21 moves back to the initial valley portion 38*a*. As a result, the lever 14 is rotated back to the initial neutral position (A0).

The electrical switch structure 40 thus far described as the third embodiment of the invention pertains to an electrically latching type of switch device since the lever 14 is latched in the actuated position (A1) (A2) by energizing the solenoid 2 in compliance with the rotational operation of the lever 14.

Moreover in unlatching the lever 14 it is possible to manually rotate the lever 14 back from the actuated position (A1) (A2) to the neutral position (A0) by overcoming the magnetical attractive force of the solenoid 2.

It is also to be understood that the invention is not limited to the particular embodiments thereof specifically disclosed herein, which are illustrative and exemplary, since modifications and variations thereof may be made without departing from the spirit and scope of the inventive concept.

It is claimed:

1. An electrical switch comprising:

a lever rotatably mounted in a case for movement between a neutral position and an actuated position, a switch member positioned in said case comprising a pair of normally open contacts, means on said lever to close said contacts when said lever moves to said actuated position, latch means to hold said lever in said actuated position comprising a first, central detent portion and at least one other detent portion juxtaposed to said first portion, spring biased roller means carried by said lever to engage said first detent portion when the lever is in said neutral position and to engage said other detent portion when in said actuated position, and solenoid means to move said latch means to return said lever from said actuated position to said neutral position when required to return said contacts to said normally open condition.

2. The switch of claim 1 wherein said first detent portion is positioned between second and third detent portions.

3. The switch of claim 2 wherein said first, second and third detent portions are similarly contoured valley portions.

4. The switch of claim 2 wherein said first detent portion is a valley portion and said second and third detent portions are similar ramp portions.

5. The switch of claim 1 wherein:

said latch means comprises a pair of said other detent portions in the form of ramps juxtaposed to said first detent portion which is of valley form, said lever includes a pair of grooves on a surface thereof within said case below said mounting of the lever in said case, and said solenoid means includes a spring biased moveable core element that reciprocates therein to engage with one of said grooves in compliance with the pivotal movement of said lever from said neutral position to one of said said actuated positions and to disengage from said grooves upon energization of said solenoid means, the action of said roller means on said ramps of said latch means serving to return said lever to said neutral position from an actuated position upon the disengagement of said core element from said grooves.

* * * * *